US006065649A

United States Patent [19]

Scoggins

[11] Patent Number: 6,065,649

[45] Date of Patent: May 23, 2000

[54] DISPENSING CONTAINER WITH TOP AND BOTTOM ACCESS PORTS AND A DISPENSING MANIFOLD THEREFORE

[76] Inventor: Lester E. Scoggins, 11560 Edgewood Rd., Auburn, Calif. 95603

[21] Appl. No.: 08/956,316

[22] Filed: Oct. 23, 1997

[51] Int. Cl.[7] ..... B65D 25/00

[52] U.S. Cl. ..... 222/181.2; 222/181.3; 222/185.1; 222/481; 215/399; 211/74; 141/364; 141/375; 141/106; 141/237

[58] Field of Search ..... 222/180, 181.1, 222/181.2, 181.3, 185.1, 478, 487; 215/399; 211/74, 75; 248/311.3; 141/106, 319, 320, 325–327, 237, 242–244, 332, 340, 341, 331, 364, 375

[56] References Cited

U.S. PATENT DOCUMENTS

| | | | |
|---|---|---|---|
| D. 267,856 | 2/1983 | Smith . | |
| D. 371,479 | 7/1996 | Hirst . | |
| 674,492 | 5/1901 | Birnie et al. | 222/185.1 |
| 733,294 | 7/1903 | Sternheimer | 222/181.1 |
| 1,423,944 | 7/1922 | Jones | 141/244 |
| 1,683,727 | 9/1928 | Rose | 222/490 |
| 1,761,164 | 6/1930 | Wilson | 222/181.2 |
| 2,133,770 | 10/1938 | McGlohon | 141/364 |
| 2,362,523 | 11/1944 | Armstrong, Jr. et al. | 215/399 |
| 2,385,600 | 9/1945 | Banua | 222/248 |
| 2,529,365 | 11/1950 | Barksdale | 222/181.2 |
| 2,773,521 | 12/1956 | Persson | 141/364 |
| 3,071,281 | 1/1963 | Sawai . | |
| 3,078,016 | 2/1963 | Judy . | |
| 3,156,272 | 11/1964 | Indrunas | 141/319 |
| 3,202,324 | 8/1965 | Honnet et al. . | |
| 3,638,823 | 2/1972 | McCoy | 215/399 |
| 3,744,658 | 7/1973 | Fujio | 215/399 |
| 3,872,868 | 3/1975 | Kline | 604/403 |
| 3,883,024 | 5/1975 | Thomas . | |
| 3,998,360 | 12/1976 | Mack | 222/181.1 |
| 4,018,363 | 4/1977 | Cassia | 222/80 |
| 4,085,867 | 4/1978 | Heller | 222/181.3 |
| 4,101,043 | 7/1978 | Johnson, Jr. et al. | 215/399 |
| 4,105,142 | 8/1978 | Morris, Jr. | 141/319 |
| 4,121,741 | 10/1978 | Adamson | 222/181.2 |
| 4,217,941 | 8/1980 | Catalano | 141/319 |
| 4,228,928 | 10/1980 | Hocker et al. | 222/181.3 |
| 4,285,074 | 8/1981 | Leinberry | 4/227.3 |
| 4,428,507 | 1/1984 | Sneider | 222/105 |
| 4,678,102 | 7/1987 | Ryder . | |
| 4,832,095 | 5/1989 | Bonnell | 141/106 |
| 5,044,522 | 9/1991 | Roig et al. . | |
| 5,105,858 | 4/1992 | Levinson | 222/185.1 |
| 5,183,182 | 2/1993 | Comstock et al. . | |
| 5,269,354 | 12/1993 | Koberg | 141/106 |
| 5,353,965 | 10/1994 | Lee | 222/143 |
| 5,375,741 | 12/1994 | Harris | 222/185.1 |
| 5,421,488 | 6/1995 | Ehrbar | 222/185.1 |
| 5,452,825 | 9/1995 | Comstock et al. . | |
| 5,540,264 | 7/1996 | Harp | 141/106 |
| 5,655,580 | 8/1997 | Schrock | 141/332 |

*Primary Examiner*—J. Casimer Jacyna
*Attorney, Agent, or Firm*—Bernhard Kreten

[57] ABSTRACT

A dispensing container for viscous fluids formed of a tubular body having top and bottom surfaces with the top surface including a threaded outlet neck and the bottom surface including a recessed portion with a female threaded opening. The container is designed to operate in an upside-down manner to take advantage of gravity flow. A hanger ring is provided which pivots out of the recessed portion to suspend the container in an upside-down position. A plurality of bottles can be vertically supported by a dispensing manifold to yield different dispensing relationships.

55 Claims, 9 Drawing Sheets

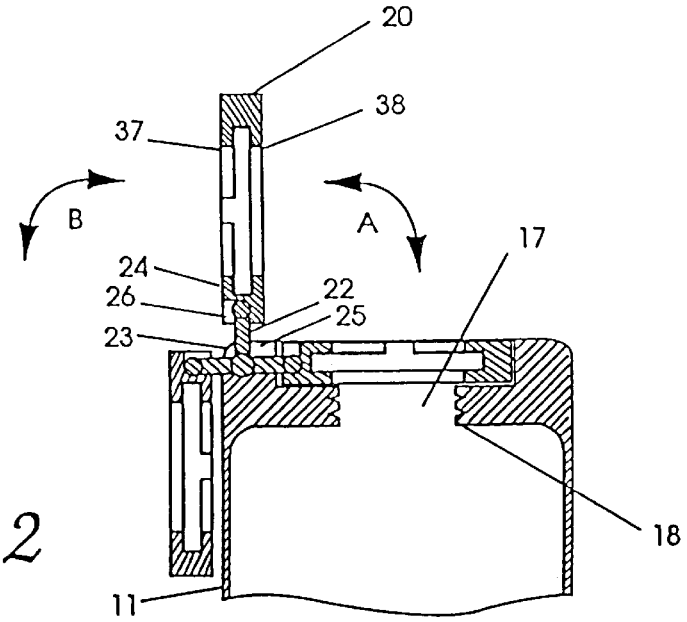
Fig. 2
Fig. 3
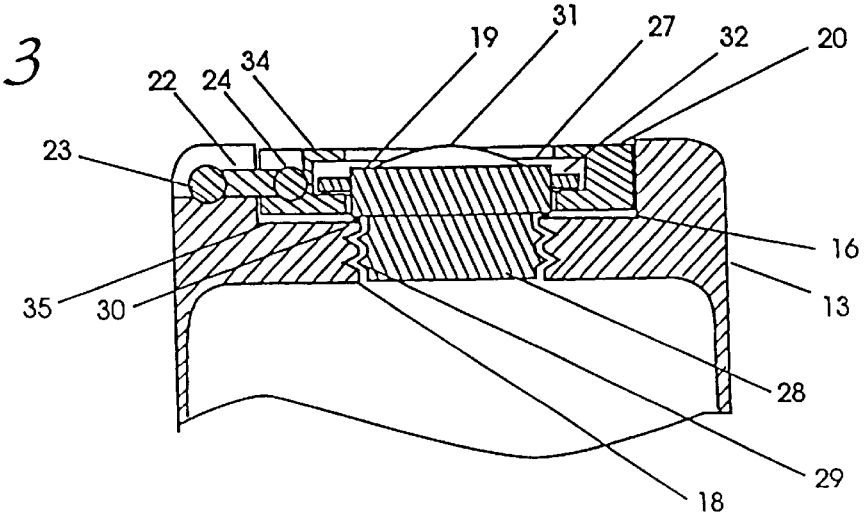

DISPENSING CONTAINER WITH TOP AND BOTTOM ACCESS PORTS AND A DISPENSING MANIFOLD THEREFORE

FIELD OF THE INVENTION

This invention relates to fluid containers having top and bottom openings to gain access to the interior. This invention also relates to manifolds for dispensing fluids from a container such as that described above.

BACKGROUND OF THE INVENTION

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 1,683,727 | September 11, 1928 | Rose |
| 2,362,523 | November 14, 1944 | Armstrong, Jr., et al. |
| 2,385,600 | September 25, 1945 | Banua |
| 3,071,281 | January 1, 1963 | Sawai |
| 3,078,016 | February 19, 1963 | Judy |
| 3,202,324 | August 24, 1965 | Honnet, et al. |
| 3,872,868 | March 25, 1975 | Kline |
| 3,883,024 | May 13, 1975 | Thomas |
| 3,998,360 | December 21, 1976 | Mack |
| 4,018,363 | April 19, 1977 | Cassia |
| 4,085,867 | April 25, 1978 | Heller |
| 4,101,043 | July 18, 1978 | Johnson, Jr., et al. |
| 4,121,741 | October 24, 1978 | Adamson |
| 4,228,928 | October 21, 1980 | Hocker, et al. |
| 4,285,074 | August 25, 1981 | Leinberry |
| Des. 267,856 | February 8, 1983 | Smith |
| 4,428,507 | January 31, 1984 | Sneider |
| 4,678,102 | July 7, 1987 | Ryder |
| 5,044,522 | Swptember 3, 1991 | Roig, et al. |
| 5,183,182 | February 2, 1993 | Comstock, et al. |
| 5,353,965 | October 11, 1994 | Lee |
| 5,421,488 | June 6, 1995 | Ehrbar |
| 5,452,825 | September 26, 1995 | Comstock, et al. |
| Des. 371,479 | July 9,1996 | Hirst |

U.S. Pat. No. 3,071,281 discloses a tubular container provided with threaded neck at each end which can be sealed with a threaded cap. The interior of the container can be accessed from either end. However, those ends are not complimentary formed, among other short-comings vis-a-vis the invention at issue.

U.S. Pat. No. 4,085,867 discloses a dispensing system having a particular utility in a shower to dispense shampoo. A plastic container having a top opening to receive shampoo is provided with a squeeze pump on its lower end to dispense shampoo. A series of bottles is supported on the wall of a shower by means of an adhesively secured track. However, among other differences from the instant invention, it does not have complimentarily formed ends.

U.S. Design Pat. No. 267,856 shows a cylindrical container with access ports at both ends. Again, the ends are not complimentarily formed. Nor does it provide a flush mounted hanging device.

U.S. Design Pat. No. 371,479 shows a shower dispenser with a pivoting hook to suspend the dispenser from a support (not shown). Though even is hook does not provide for flush mounting, nor is it able to be contained within a liquid-fill opening.

The other prior art listed above, but not specifically discussed, teach other devices which further catalog the prior art of which the applicant is aware. These references diverge even more starkly from the references specifically distinguished above.

SUMMARY OF THE INVENTION

This invention is directed to a design of a unique container and a dispensing manifold for diverse applications. The container includes a flat bottom and an upper threaded neck with a screw-on cap to serve as a pouring outlet. However, the main purpose of this container is to operate in an upside down manner so that viscous fluids such as thick shampoo can be more easily dispensed. Also, while the container is so inverted, the bottom opening, now on the top, can be coupled to a second, third, or more inverted containers to act as a source of supply for the primary container.

An important advantage in the above arrangement is that a viscous fluid which normally must be forced out of a half empty container by vigorous shaking now moves by gravity to the outlet of the container where it can be more easily removed. One application is in the ability to exhaust the last few ounces of a thick shampoo or other like fluid from an almost empty purchased container which is normally discarded. By inverting the almost empty container and attaching it to the primary container which is also inverted, the residual fluid clinging to the walls will slowly flow into the inverted primary container where it can be utilized.

In its simplest form, the novel container can be suspended in an upside down fashion flush to a wall by a foldable hanger-ring concealed in the bottom and which may be unfolded to be supported by a separate hook adhesively attached to a wall The novel container of this invention has been combined with a special manifold to further extend its utility. The manifold can be self-supporting on a plurality of legs or can be secured to the wall of a shower. The manifold has a plurality of integral funnel-shaped structures which can support the novel container in many dispensing relationships.

A further manifold design is in the form of a pedestal mounted carousel to dispense fluids such as condiments.

OBJECTS OF THE INVENTION

Accordingly, it is an overall object of the present invention to provide a container to dispense fluids, particularly viscous fluids, such as shampoo. The design philosophy is based on the principle of gravity flow achieved by mounting the container upside down in a vertical position, allowing the viscous fluid to always settle in the bottom while unattended.

It is a primary object of the present invention to provide a device as characterized above which provides a container with a female threaded opening at the bottom which can serve as a filler port when the container is placed upside down in its operative dispensing position. A supply container having a male thread compatible with the female thread of the dispensing container can be attached to the dispensing container and supported thereby in a vertical position to slowly empty its contents therein. This can be continued in series with additional bottles as designed. The openings can also be fitted with caps, pumps, valves or the like. A cap threaded onto a male threaded coupling on the opposite end from the filler port can seal or unseal the container as needed for disposing of fluid after filling.

It is a further object of the present invention to provide a device as characterized above which includes a hanger-ring flush mounted within the flat bottom of the container to be outwardly pivoted so as to be able to suspend the container in a vertical position flush with a wall.

It is a further object of the present invention to provide a device as characterized above which employs a dispensing manifold in the form of an elongated plate to support a number of bottles in different dispensing relationship.

It is a further object of the present invention to provide a device as characterized above which mounts a plurality of the novel dispensing bottles on a rotating circular plate to serve as a rotating carousel.

Viewed from a first vantage point it is an object of the present invention to provide a container comprising, in combination, a hollow fluid impervious body, a top end having an opening, a bottom end having an opening, first coupling means on the bottom end, second coupling means on the top end, and the first and second coupling means complimentarily formed.

Viewed from a second vantage point it is an object of the present invention to provide a container hanging apparatus, comprising in combination, a ring, hinge means, enabling the container with pivotal movement, the hinge means including a tether arm pivotally mounted at one end in a bottom container surface and pivotally mounted at the other end on the ring whereby the ring can pivot from a position within a recessed portion to a vertical raised position and to a folded position to lie astride the container.

Viewed from a third vantage point it is an object of the present invention to provide a carousel for dispensing a plurality of viscous fluids, comprising in combination, a circular plate supported on a pedestal, bearing means between the pedestal and plate to enable rotation of the plate, a plurality of integral funnel-shaped structures spaced around the periphery of the circular plate, each funnel-shaped structure comprising a shallow collection bowl with an opening at its bottom, the opening terminating in a spout, a female thread in the spout adjacent the bowl bottom opening, a cylindrical neck at one end portion of the spout, a male thread on the neck, fluid control means threaded onto the male thread, and a viscous fluid containing container with a threaded outlet neck threaded into the female thread in the spout.

Viewed from a fourth vantage point it is an object of the present invention to provide a method for dispensing a fluid from a dispensing container having an outlet neck and closure on its top surface and a flat bottom base, the method comprising the steps of forming a threaded opening in the base in fluid communication with the interior of the container, aligning and coupling an outlet neck of a supply container to the threaded opening in the dispensing container, and mounting the dispensing container and supply container in an upside-down vertical position so that the fluid content in the container acts against the closure by gravity, so that the contents of the supply container drain by gravity into the dispensing container.

Viewed from a fifth vantage point it is an object of the present invention to provide a manifold for filling containers, comprising, in combination, a support surface having at least one funnel supported on the surface and passing therethrough, and clearance above and below the surface to receive, respectively, a bottle thereabove and a container therebelow in registry with an opening in the funnel.

These and other objects will be made manifest when considering the following detailed specification when taken in conjunction with the appended drawing figures.

BRIEF DESCRIPTION OF THE DRAWINGS

FIG. 2 is a sectional view of the bottom portion of the container illustrating the different positions of the support ring.

FIG. 3 is a sectional view similar to FIG. 2 showing the support ring and stopper in a closed position.

DESCRIPTION OF PREFERRED EMBODIMENTS

Figure 1:
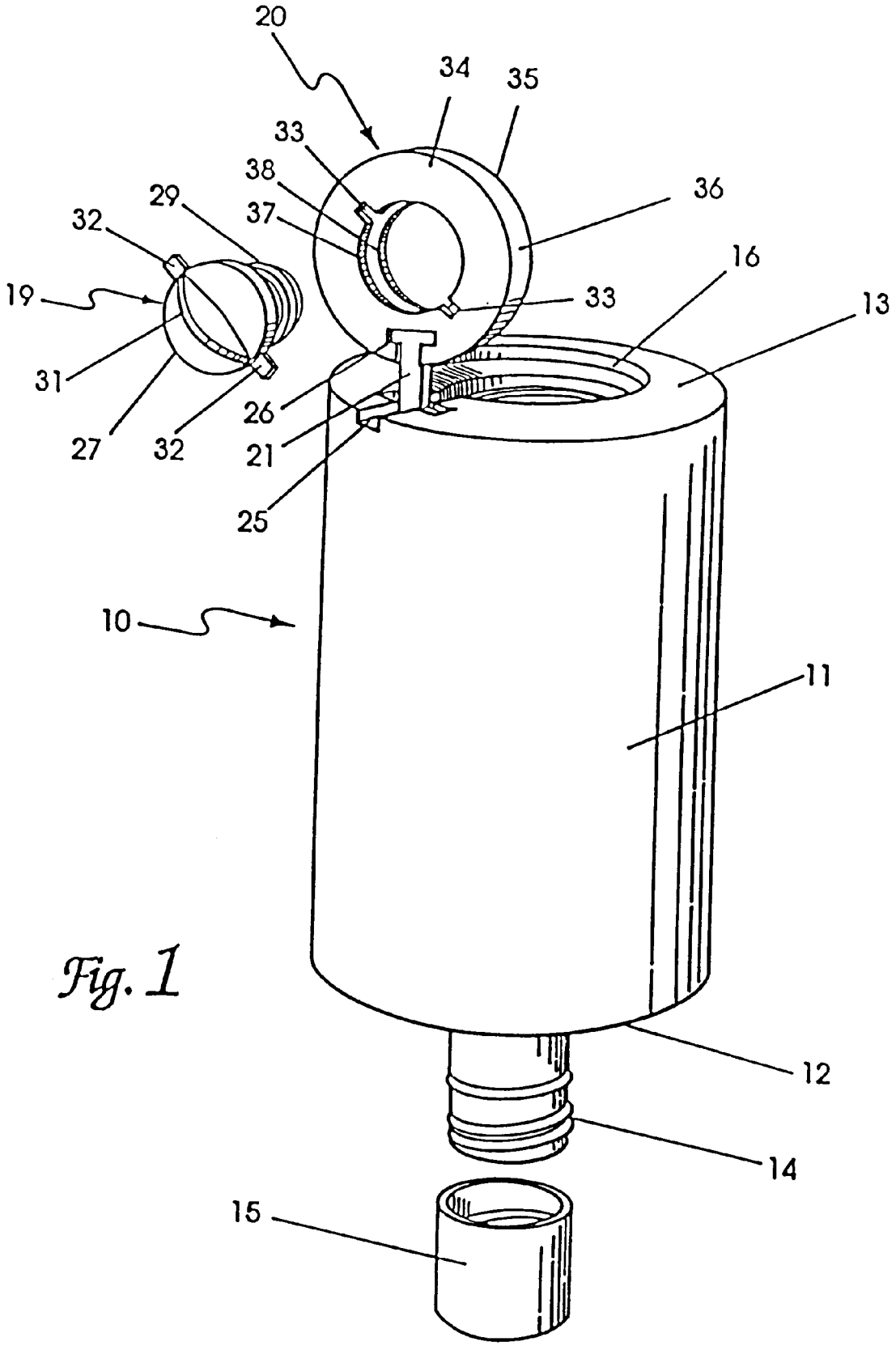
FIG. 1 is a perspective view of the container of this invention with the stopper and cap removed and the support ring in a raised position. The cap is in sectional view.

Considering the drawings, wherein like reference numerals denote like parts throughout the various drawing figures, reference numeral 10 is directed to the overall container according to the present invention. While the container of this invention can be tubular, parallel, piped or spherical in shape, it is preferred to employ a cylindrical container because of certain manufacturing simplifications and the ability of a cylindrical shape to contain a maximum volume. The invention will be described in terms of a cylindrical container, although it should be understood that other shapes can be employed.

Referring now in particular to FIGS. 1 through 5, container 10 which is shown in an upside-down position for explanatory purposes, has a cylindrical body 11 with a generally flat top 12 and flat bottom 13. The flat top 12 is provided with a conventionally threaded container neck 14, preferably 24 mm or other industry standard diameter, which can be sealed with a matching threaded cap 15.

The flat bottom 13 has a circular recess 16 which communicates with a smaller opening 17 in the container bottom. The opening preferably has an industry standard 24 mm female thread 18 to receive a threaded stopper 19 or the threaded neck of another container in stacked relationship. A swivel hanger-ring 20, to support the container 10 in an upside-down position, is pivotally mounted on flat bottom 13 by means of a swivel hinge 21 for pivotal movement into and out of circular recess 16. Swivel hinge 21 is formed of a swivel tether 22 (FIGS. 2 through 5) having an internal pivot hinge 23 at one end and an external pivot hinge 24 at the other end. Swivel hinge 21 is received in a cross-shaped slot 25 in bottom 13 with internal pivot hinge 23 being pivotally mounted within the cross while the tether 22 is moveable into and out of the slot stem. The external pivot hinge 24 of the swivel tether is mounted in a T-shaped slot 26 recessed in the swivel hanger-ring 20 as best seen in FIG. 1.

Operation of the swivel hinge 21 to control movement of hanger-ring 20 will be explained in connection with FIG. 2 which shows the hanger-ring 20 in three different positions. In the vertical position, internal pivot 23 rotates in end holes (not shown) in the cross-arm to position the tether 22 in a vertical position. External pivot 24 captured in the T-shaped slot supports the hanger in a vertical position. Since the tether 22 and pivot 24 rest on the bottom of the T-shaped slot 26 as best shown in FIG. 2, hanger 20 cannot rotate in a clockwise position with respect to the pivot, but can rotate with respect thereto in a counter-clockwise direction. When the hanger 20 is rotated in a clockwise or closing direction, the hanger 20 and tether 22 pivot together around pivot hinge 23 where it is positioned within circular recess 16. As shown by the double arcuate arrow A in FIG. 2, hanger 20 can be arcuately rotated into and out of recess 16. Hanger 20 can also be rotated from the vertical position shown in FIG. 2 to an inactive stowed position where it hangs parallel to the cylindrical body 11. By rotating in a counter-clockwise direction in FIG. 2, hanger 20 is now free to pivot around external pivot 24 since it is no longer blocked by the tether in slot 26. The tether 22 and internal hinge 21 can now rotate to place the hanger 20 in a folded inactive position. Also, as shown by the double arcuate arrow B in FIG. 2, the hanger can be rotated around pivots 23 and 24 from an inactive position to an active position and vice versa.

Figure 4:
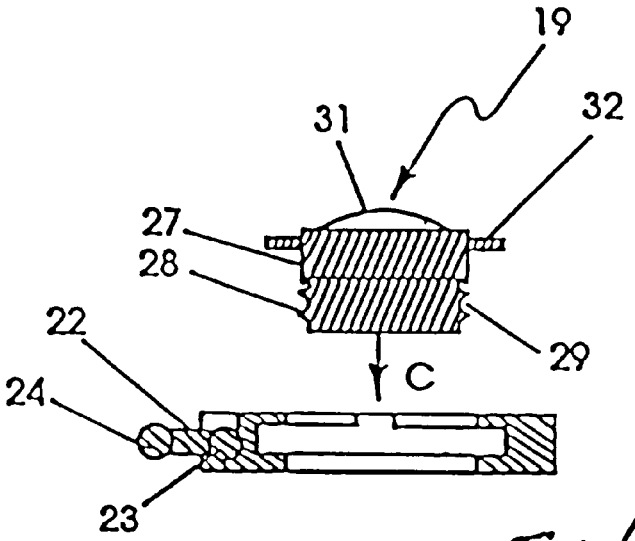
FIG. 4 is a sectional view of the support ring and stopper alone with the stopper in an open position.
Figure 5:
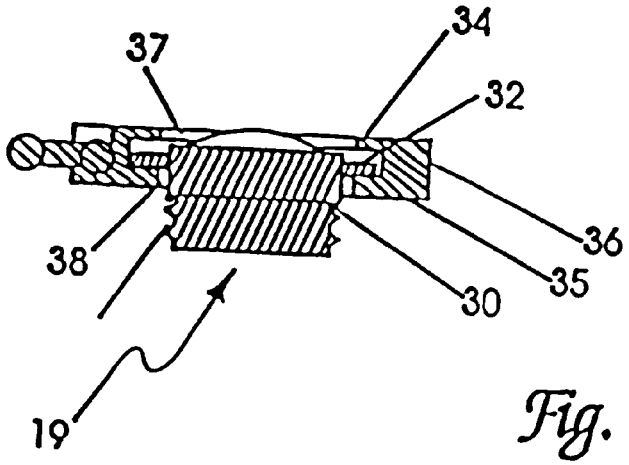
FIG. 5 is a sectional view similar to FIG. 4 with the stopper in a closed position.

Referring to FIGS. 3 through 5, a combined threaded stopper and latch 19 is described which serves the dual purpose of sealing threaded opening 17, 18 and latching hanger 20 within recess 16. The stopper 19 is of a solid cylindrical shape having a larger diameter section 27 integrally formed with a smaller diameter section 28 which is provided with threads 29 so that the stopper 19 can be screwed into opening 17 to seal the container bottom. A plastic washer 30 which can be an O-ring, surrounds the upper portion of section 28 to seal the opening 17. A tab 31 is integrally formed on the upper surface of section 27 to serve as a finger grip to rotate the stopper 19.

Stopper 19 also serves to latch hanger-ring 20 within recess 16. For this purpose, stopper portion 27 has diametrically opposed ears 32 (FIG. 1) which index with slots 33 in hanger-ring 20. The hanger ring is formed of a top circular plate 34 and a bottom circular plate 35 joined by a cylindrical rim 36. Slots 33 are formed in top plate 34 along with a circular opening 37 just wide enough to receive stopper 19. Bottom circular plate 35 has a matching opening 38. In use, tab 31 is gripped by fingers and the stopper 19 inserted in openings 37 and 38 with ears 32 indexing with slot 33 so that the ears 32 rest on bottom plate 35 (FIG. 5). The stopper and ring are then rotated into recess 16 and the stopper 19 is screwed into opening 17 until washer 30 seals the opening 17.

Figure 6:
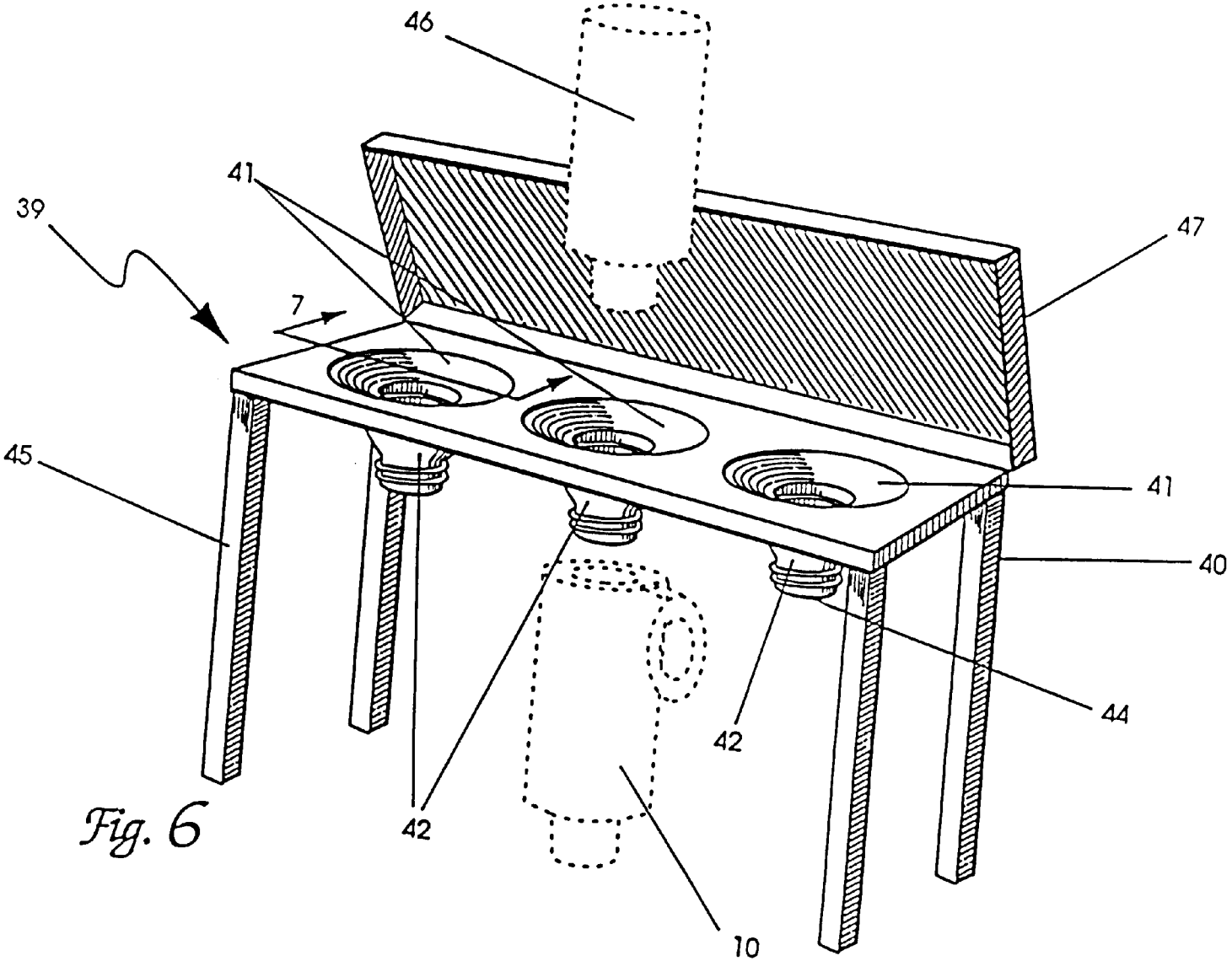
FIG. 6 is a perspective view of a three-port table supported manifold usable with the container of FIG. 1.
Figure 7:
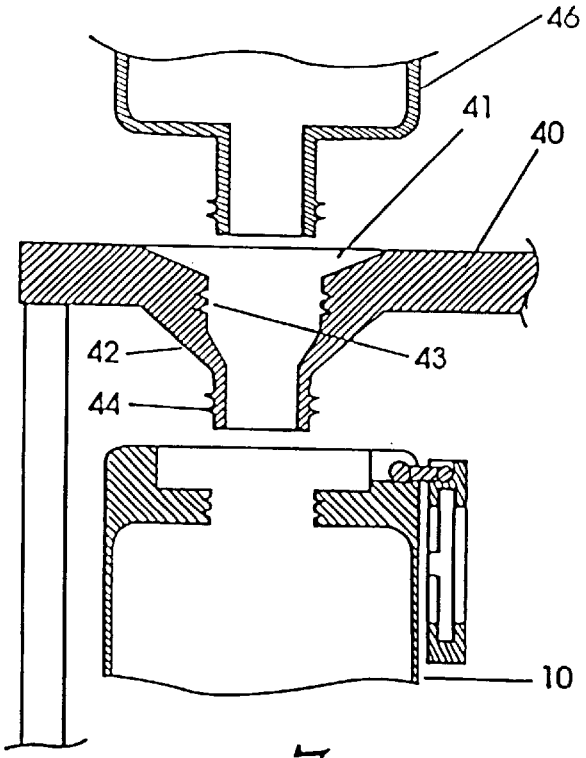
FIG. 7 is an exploded sectional view showing the relationship between a supply container and a receiving container in the funnel of the FIG. 6 manifold at 7—7.
Figure 8:
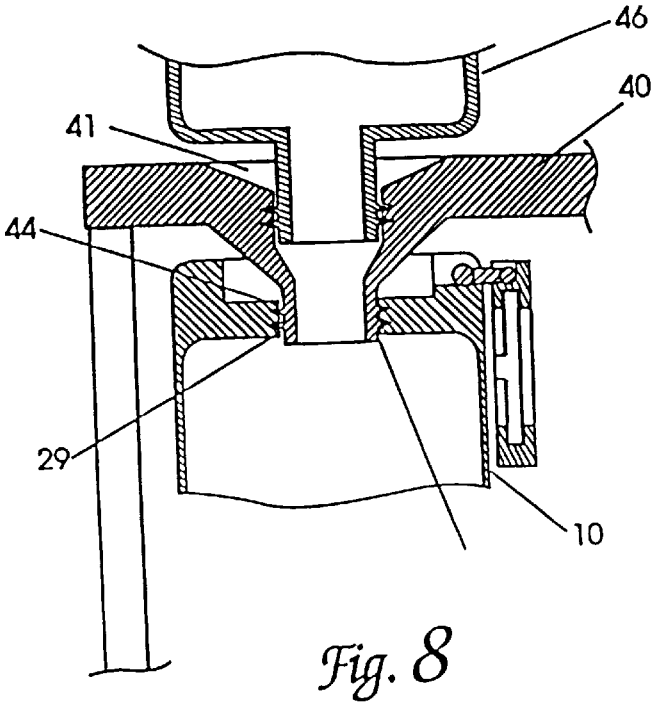
FIG. 8 is a view similar to FIG. 7 showing the bottles in a connection position.

The container described above is adapted to a wide variety of dispensing applications which will now be described. FIGS. 6 through 8 show a three-port manifold 39 comprising a substantially flat plate 40 having three spaced receiving funnels 41 formed in its upper surface. Each funnel 41 has a funnel spout 42 which extends below the flat plate 40 and which is provided with a 24 mm female thread 43 internally of the funnel spout and a 24 mm male thread 44 on the outside neck of the spout. Any thread diameter could be used, but that of the most used industry standard is described herein.

The flat plate 40 of the manifold 39 has four legs 45 which support the plate above a table or bench at a sufficient height to conveniently attach the container to the threads 44 on the neck of the spout. In use, stopper 19 is removed from hanger 20 of container 10 and the hanger 20 is rotated to an inactive position. Container 10 is then screwed onto threaded neck 44 as shown in FIG. 8. A purchased container 46 containing shampoo or any other viscous fluid is placed above funnel 41 and the cap is removed and the container neck quickly threaded into the threaded opening 43 in the funnel spout 42. The viscous shampoo will slowly flow into container 10 until filled. The filled container 10 is then removed and capped with stopper 19 and a replacement container immediately put into place. Because of the viscous nature of the fluid, very little is lost during the transfer of bottles. The filling operation can proceed unattended and container replacement made at the convenience of the operator. A cover 47 is hinged to plate 40 to cover the funnel openings 41 when not in use.

The versatility and advantages of this arrangement are many. For example, a beauty supply retailer or wholesaler can purchase shampoo in bulk quantity and fill the bottles 10 to be sold under a private label. Purchasers of the filled bottles can return to have them refilled, saving the cost of the container and reducing the waste of material, thereby enhancing the quality of the environment.

Figure 9:
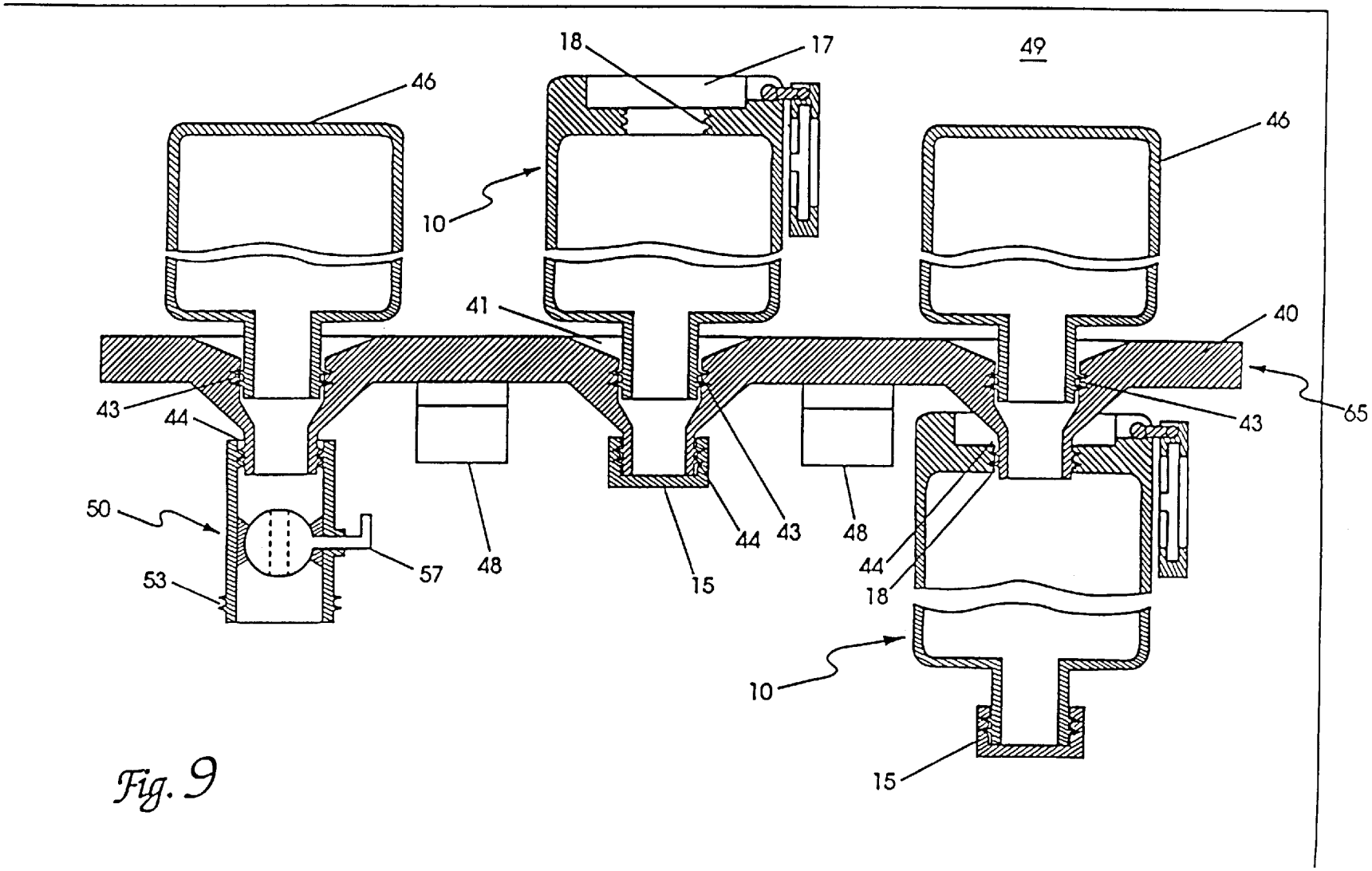
FIG. 9 is a sectional view of a three-port manifold designed to be mounted on the wall of a shower.

FIG. 9 is a variation of the FIGS. 6 through 8 embodiment which is designed to be used in a shower. The same reference numerals employed in FIGS. 6 through 8 will be used to designate similar components. Instead of legs 45, plate 40 is formed with support brackets 48 having a pressure sensitive adhesive, or some other securing means, to secure the manifold to the wall 49 of a shower.

The various uses of the manifold 65 will now be described in going from left to right in FIG. 9. Purchased container 46 filled with shampoo is screwed into threaded opening 43 so that the shampoo will drain by gravity into the funnel neck 42. Instead of controlling dispensing by screwing and unscrewing a dispensing cap, a dispensing ball valve 50 is screwed onto the threaded neck 44 to accomplish this purpose.

Figure 10:
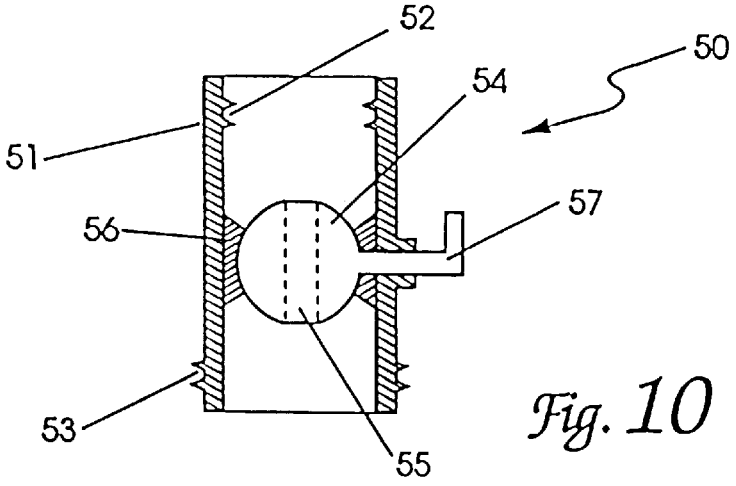
FIG. 10 is a sectional view of a ball valve usable with the container of the invention.

Ball valve 50, shown in detail in FIG. 10, comprises a housing 51 having a 24 mm female thread 52 and a 24 mm male thread 53 at the inlet and outlet respectively. A spherical ball valve 54 with an opening 55 is rotated on seat 56 by means of handle 57 to an open and closed position.

In use, shampoo is dispensed by rotating handle 57 to open position. Male threads 53 may be optionally employed to attach a flexible hose extension, if desired. It should by understood that slide or push valves can also be used instead of a ball valve.

The center receiving funnel 41 supports the container 10 which is screwed into threaded opening 43. Shampoo will flow by gravity into threaded neck 44 where dispensing can be controlled by a threaded cap 15. Of course, a dispensing valve such as shown at 50 can by used instead of the cap 15. The opening 17 is not stoppered as shown, but stopper 19 may be screwed into the threads 18 to seal the opening or to be slightly loose to admit air to break any vacuum. Alternatively, it is important to note that a purchased container 46 or container 10 filled with shampoo can be screwed into threaded opening 17, 18 to provide a backup supply of shampoo.

The right end funnel 41 supports a purchased container which is screwed into threaded opening 43 of the manifold 65. The threaded opening 18 in the container is screwed onto threaded neck 44, as also shown in FIG. 9 to be in fluid communication with the purchased container 46. Shampoo in container 46 will slowly flow by gravity into container 10. Dispensing is achieved by the opening and closing of cap 15. Alternatively, a ball valve such as shown at 50 may be used instead of the cap.

The arrangement as in the right end funnel above wherein the top container drains into the bottom container yields desirable advantages. It is common for a consumer to throw away an almost empty container of an expensive hair care product rather than waiting for the last few ounces to drain out. With the above arrangement, the contents in container 46 drains down completely representing a savings to the consumer.

Figure 11:
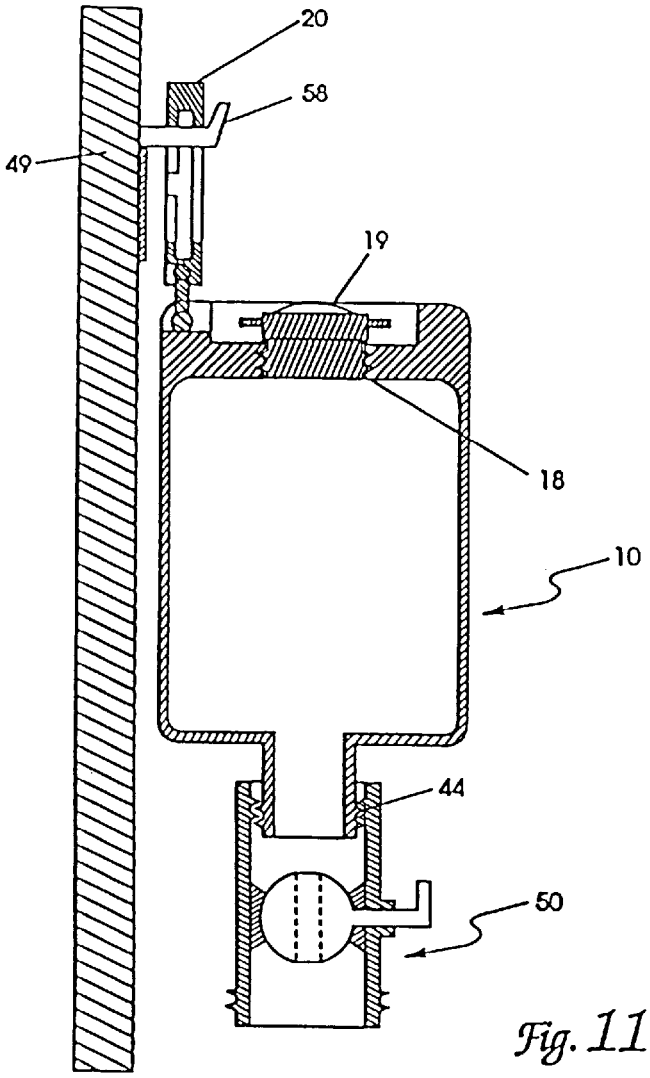
FIG. 11 is a sectional view of a single container of the invention suspended by a hook secured to a wall.

FIG. 11 shows the container 10 suspended from hook 58 secured to shower wall 49. Swivel hanger ring 20 is moved to the vertical position shown in FIG. 2 and positioned on hook 58. Ball valve 50 is attached to neck 44 to control dispensing, although a simple cap 15 can also function here. Although the container 10 is shown capped by stopper 19, a purchased container 46 can be screwed into hole 18 instead of the stopper as explained above in connection with FIG. 9.

Figure 12:
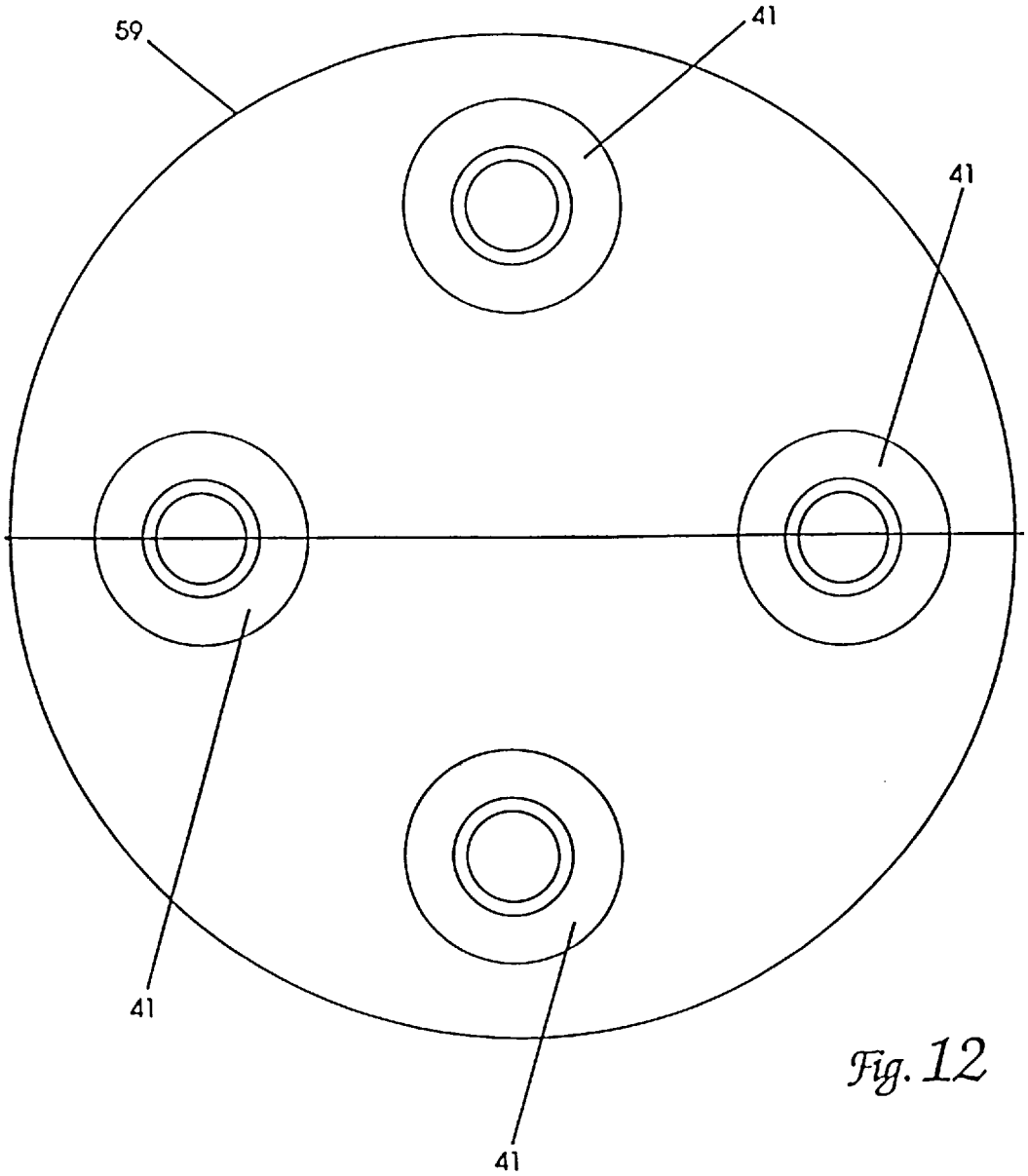
FIG. 12 is a top view of a four-port carousel.
Figure 13:
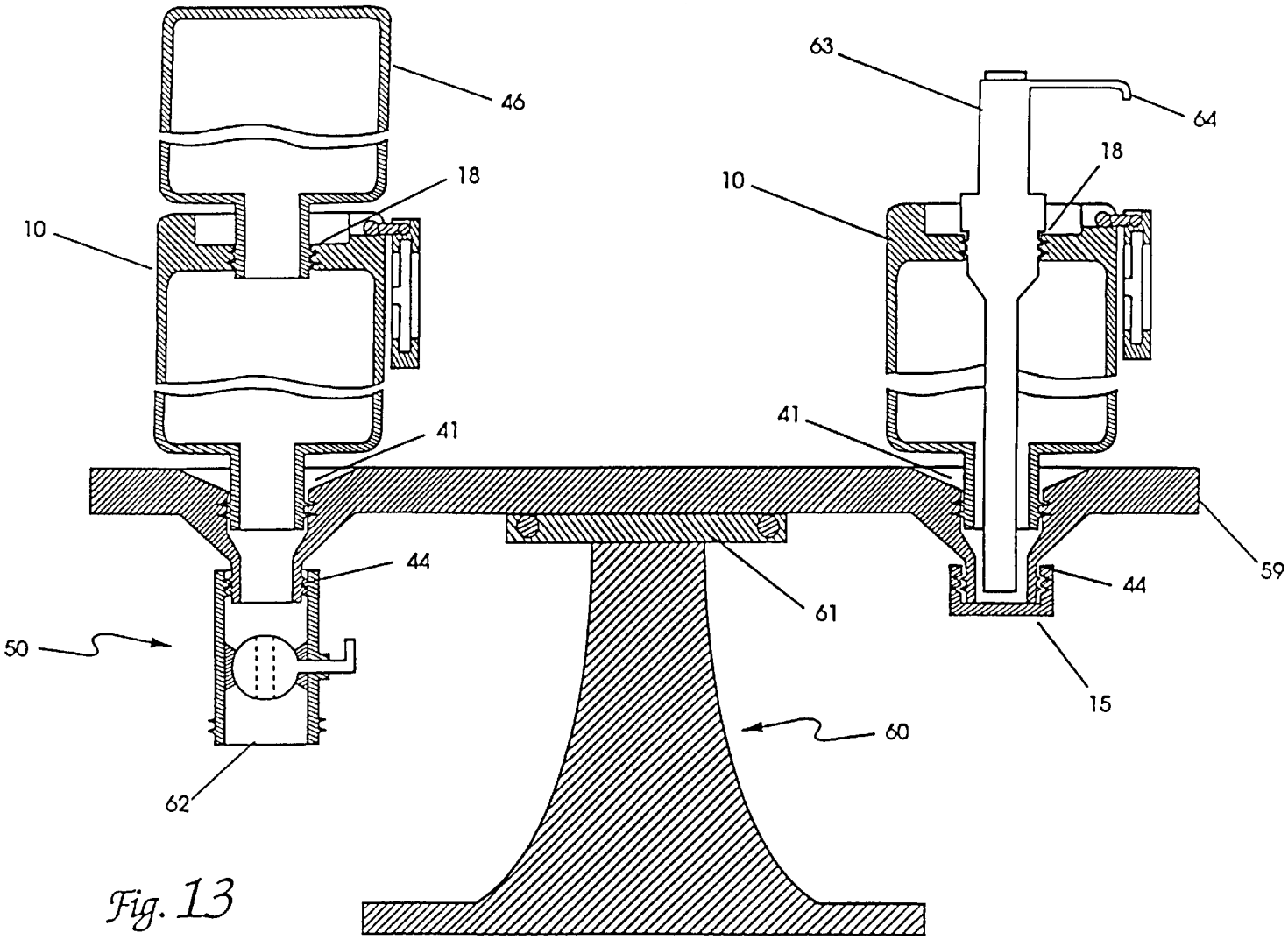
FIG. 13 is a partial sectional side view of the FIG. 12 carousel illustrating bottles of this invention in operative relationship.

FIGS. 12 and 13 show a carousel 59 designed around the container 10. The same reference numerals used previously will be used to designate similar components. A circular manifold 59 is provided with four equally spaced receiving funnels 41 constructed as shown in FIGS. 6 through 9. The circular manifold 59 is rotatably supported on pedestal 60 by means of ball bearings 61. Each funnel 41 supports a container 10 or 46 containing a condiment which may include oil, vinegar, mustard, catsup, or any viscous fluid.

Assume the left container in FIG. 13 contains olive oil. Since olive oil pours freely, the outlet neck 44 must be provided with some kind of valve dispenser, here shown as ball valve 50. A metering and distribution plate 62 inserted in the outlet may also by necessary. A backup purchased container 46 or another inventive container 10 can be added to threaded opening 18 to increase capacity.

Assume the other container 10 on the carousel contains a highly viscous mustard that will not readily flow through outlet neck 44. In this case the neck 44 is closed with cap 15 and a conventional fluid pump 63 is screwed into opening 18 in the container so that the pump inlet extends into the neck area. Operation of pump 63 will deliver thick mustard out of nozzle opening 64. Of course, with a less viscous condiment, a valve may be used instead of cap 15, either alone or in combination with the pump.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A container comprising, in combination:

a hollow fluid impervious body;

a top end having an opening and a cap removeably attached thereto;

a bottom end having an opening and a stopper removeably attached thereto;

first coupling means on said bottom end;

second coupling means on said top end;

said first and second coupling means complimentarily formed; and a hanging means operatively coupled to said bottom end and stopper at said stopper to allow said container to be suspended by said hanging means.

2. The container of claim 1 further comprising a recessed portion in said bottom end circumscribing said first coupling means on said bottom end.

3. The container of claim 2 further comprising said container hanging means mounted on said bottom end in registration with said first coupling means on said bottom end for movement into and out of said recessed portion.

4. The container of claim 3 further comprising a stopper, coupleable to said bottom end first coupling means, registry means on said stopper for registering said hanging means into said recess portion between said stopper and said coupling means.

5. The container of claim 1 wherein said top end opening includes a neck extending outwardly from said top end.

6. The container of claim 5 wherein said neck includes external male threads.

7. The container of claim 6 wherein said neck is a standardized diameter.

8. The container of claim 7 wherein said neck is 24 mm diameter.

9. The container of claim 8 wherein said bottom end opening includes a throat extending inwardly from said bottom end.

10. The container of claim 9 wherein said throat includes internal female threads.

11. The container of claim 10 wherein said throat is a standardized diameter.

12. The container of claim 11 wherein said throat is 24 mm diameter.

13. The container of claim 12 further comprising a recessed portion in said bottom end circumscribing said throat.

14. The container of claim 13 further comprising hanging means mounted on said bottom end in registration with said throat for movement into and out of said recessed portion.

15. A manifold for filling containers from bottles, comprising, in combination:

a support surface having at least one funnel supported on said surface and passing therethrough; and clearance above and below said surface to receive, respectively, a bottle thereabove and a container therebelow in registry with an opening in said funnel;

said container comprising, in combination:

a hollow fluid impervious body;

a top end having an opening and a cap removeably attached thereto;

a bottom end having an opening and a stopper removeably attached thereto;

first coupling means on said bottom end;

second coupling means on said top end;

said first and second coupling means complimentarily formed; and a hanging means operatively coupled to said bottom end and stopper at said stopper to allow said container to be suspended by said hanging means;

where said funnel has a discharge spout with male threads which docks with said bottom end of said container.

16. The manifold of claim 15 further comprising docking means between said bottle, funnel and container.

17. The manifold of claim 16 wherein said funnel includes a mouth, a throat and a neck.

18. The manifold of claim 17 wherein said mouth is wider than said throat and said throat is between said mouth and said neck.

19. The manifold of claim 18 wherein said throat includes internal female threads and said neck includes external male threads, said male and female threads complementarily diametrical.

20. The manifold of claim 19 wherein said neck and throat threads are 24 mm diameter.

21. The manifold of claim 20 wherein said support surface is rectangular.

22. The manifold of claim 21 wherein said support surface includes a cover hinged to said surface at an edge.

23. The manifold of claim 22 wherein said support means includes a plurality of legs coupled to a bottom side of said support surface.

24. The manifold of claim 21 wherein said support means includes hinge means attached to said surface.

25. A container comprising, in combination:

a hollow fluid impervious body;

a top end having an opening;

a bottom end having an opening;

first coupling means on said bottom end;

second coupling means on said top end;

said first and second coupling means complimentarily formed;

a recessed portion in said bottom end circumscribing said first coupling means on said bottom end;

a container hanging means mounted on said bottom end in registration with said first coupling means on said bottom end for movement into and out of said recessed portion; and a stopper, coupleable to said bottom end first coupling means, registry means on said stopper for registering said hanging means into said recess portion between said stopper and said coupling means.

26. The container of claim 25 wherein said first coupling means is a female threaded coupling and said second coupling means is a male thread coupling circumscribing said respective openings.

27. The container of claim 26 wherein said hanging means includes a ring and hinge means, enabling said container hanging means with pivotal movement, said hinge means including a tether arm pivotally mounted at one end in said bottom surface and pivotally mounted at the other end on said ring whereby said ring can pivot from a position within said recessed portion to a vertical raised position and to a folded position to lie astride said container.

28. The container of claim 27 wherein said hinge means further comprises:

a cross-shaped slot in said bottom surface, one end of said tether arm being pivotally mounted in the cross arm of said cross-shaped slot;

a T-shaped slot in said hanger ring; and said tether arm other end being pivotally mounted in the cross arm of said T-shaped slot.

29. The container of claim 28 wherein said tether arm and said hanger ring lie flush with said bottom end within said recess when said hanger ring is in a position whereby the container can rest in a stable upright position.

30. The container of claim 26 including a hook fastened to a wall, the hanger means supported by said hook whereby said container is suspended by said hook so that said top end and said bottom end become inverted.

31. The container of claim 30 wherein said container is filled with a viscous fluid, means at said male threaded coupling to control the dispensing of said fluid.

32. The container of claim 31 wherein the means to control dispensing comprises a threaded cap which can be threaded onto said male threaded coupling.

33. The container of claim 31 wherein the means to control dispensing comprises a threaded valve which can be threaded onto said male threaded coupling.

34. The container of claim 26 wherein said hanger means comprises a top circular plate, a bottom circular plate and a cylindrical rim joining said plates at peripheral edge portions, said top circular plate having opposed slots, said threaded stopper having complimentarily formed opposed ears in registration with said slots whereby when said threaded stopper is threaded into said female threads in said bottom opening, said stopper ears pass through said slots and rest on said bottom circular plate to simultaneously lock said hanger means in said recessed portion and to seal said opening in said bottom surface.

35. The container of claim 25 including a manifold to receive said container.

36. A container comprising, in combination:

a hollow fluid impervious body;

a top end having an opening;

a bottom end having an opening;

first coupling means on said bottom end;

second coupling means on said top end; and said first and second coupling means complimentarily formed;

wherein said top end opening includes a neck extending outwardly from said top end;

wherein said neck includes external male threads;

wherein said neck is a standardized diameter;

wherein said neck is 24 mm in diameter;

wherein said bottom end opening includes a throat extending inwardly from said bottom end;

wherein said throat includes internal female threads;

wherein said throat is a standardized diameter;

wherein said throat is 24 mm in diameter;

further comprising a recessed portion in said bottom end circumscribing said throat; and hanging means mounted on said bottom end in registration with said throat for movement into and out of said recessed portion.

37. The container of claim 36 further comprising a stopper, said stopper having a male externally threaded neck complementarily formed to couple into said throat, registry means on said stopper for registering said hanging means into said recessed portion between said stopper and said throat.

38. The container of claim 37 wherein said hanging means includes a ring and hinge means, enabling said container means with pivotal movement, said hinge means including a tether arm pivotally mounted at one end in said bottom surface and pivotally mounted at the other end on said ring whereby said ring can pivot from a position within said recessed portion to a vertical raised position and to a folded position to lie astride said container.

39. The container of claim 38 wherein said hinge means further comprises:

a cross-shaped slot in said bottom surface, one end of said tether arm being pivotally mounted in the cross arm of said cross-shaped slot;

a T-shaped slot in said hanger ring; and said tether arm other end being pivotally mounted in the cross arm of said T-shaped slot.

40. The container of claim 39 wherein said tether arm and said hanger ring lie flush with said bottom end within said recess when said hanger ring is in a position whereby the container can rest in a stable upright position.

41. The container of claim 40 wherein said body is tubular.

42. The container of claim 41 wherein said bottom is composed of a resilient material.

43. The container of claim 42 wherein said resilient material is plastic.

44. The container of claim 37 including a hook fastened to a wall, the hanger means supported by said hook whereby said container is suspended by said hook so that said top end and said bottom end become inverted.

45. The container of claim 36 wherein said container is filled with a viscous fluid, means at said male threaded coupling to control the dispensing of said fluid.

46. The container of claim 45 wherein said means to control dispensing comprises a female threaded cap, wherein said cap threads are coupleable to said male threads on said neck.

47. The container of claim 45 wherein the means to control dispensing comprises a female threaded valve coupleable to said male threads on said neck.

48. The container of claim 47 wherein said body is tubular.

49. The container of claim 48 wherein said bottom is composed of a resilient material.

50. The container of claim 49 wherein said resilient material is plastic.

51. The container of claim 36 including a manifold to receive said container.

52. A container comprising, in combination:

a hollow fluid impervious body;

a top end having an opening;

a bottom end having an opening;

first coupling means on said bottom end;

second coupling means on said top end; and said first and second coupling means complimentarily formed;

wherein said bottom end opening includes a throat extending inwardly from said bottom end;

further comprising a recessed portion in said bottom end circumscribing said throat; and hanging means mounted on said bottom end in registration with said throat for movement into and out of said recessed portion.

53. The container of claim 52 including a manifold to receive said container.

54. A manifold for filling containers, comprising, in combination:

a support surface having at least one funnel supported on said surface and passing therethrough; and clearance above and below said surface to receive, respectively, a bottle thereabove and a container therebelow in registry with an opening in said funnel;

said container comprising, in combination:

a hollow fluid impervious body;

a top end having an opening;

a bottom end having an opening;

first coupling means on said bottom end;

second coupling means on said top end; and said first and second coupling means complimentarily formed;

wherein said bottom end opening includes a throat extending inwardly from said bottom end;

further comprising a recessed portion in said bottom end circumscribing said throat; and hanging means mounted on said bottom end in registration with said throat for movement into and out of said recessed portion.

55. A manifold for filling containers, comprising, in combination:

a support surface having at least one funnel supported on said surface and passing therethrough; and clearance above and below said surface to receive, respectively, a bottle thereabove and a container therebelow in registry with an opening in said funnel;

said container comprising, in combination:

a hollow fluid impervious body;

a top end having an opening;

a bottom end having an opening;

first coupling means on said bottom end;

second coupling means on said top end; and said first and second coupling means complimentarily formed;

further comprising a recessed portion in said bottom end circumscribing said first coupling means on said bottom end;

a container hanging means mounted on said bottom end in registration with said first coupling means on said bottom end for movement into and out of said recessed portion; and a stopper, coupleable to said bottom end first coupling means, registry means on said stopper for registering said hanging means into said recess portion between said stopper and said coupling means.

* * * * *